US007407417B2

(12) United States Patent
Pepe et al.

(10) Patent No.: US 7,407,417 B2
(45) Date of Patent: Aug. 5, 2008

(54) ELECTRICAL CONNECTOR HAVING CONTACT PLATES

(75) Inventors: Paul John Pepe, Clemmon, NC (US); Linda Ellen Shields, Camp Hill, PA (US); Ned Sigmon, Mooresville, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/411,380

(22) Filed: Apr. 26, 2006

(65) Prior Publication Data

US 2007/0254529 A1 Nov. 1, 2007

(51) Int. Cl.
*H01R 4/24* (2006.01)

(52) U.S. Cl. ..... 439/676; 439/941

(58) Field of Classification Search ..... 439/676, 439/620, 941, 620.23, 620.11, 620.17
See application file for complete search history.

(56) References Cited

U.S. PATENT DOCUMENTS 5,580,270 A * 12/1996 Pantland et al. ..... 439/395
6,042,427 A * 3/2000 Adriaenssens et al. ..... 439/676
6,176,742 B1 * 1/2001 Arnett et al. ..... 439/620
6,319,069 B1 * 11/2001 Gwiazdowski ..... 439/676
6,332,810 B1 * 12/2001 Bareel ..... 439/676
6,409,547 B1 * 6/2002 Reede ..... 439/676
2004/0092170 A1 5/2004 Colantuono et al.
2006/0121788 A1 * 6/2006 Pharney ..... 439/676
2006/0121792 A1 * 6/2006 Hashim et al. ..... 439/676
2006/0121793 A1 * 6/2006 Pharney ..... 439/676
2006/0134992 A1 * 6/2006 Green et al. ..... 439/676
2006/0134995 A1 * 6/2006 Bolouri-Saransar et al. . 439/676

FOREIGN PATENT DOCUMENTS

| | | |
|---|---|---|
| EP | 1 059 704 | 12/2000 |
| EP | 1 063 734 | 12/2000 |
| EP | 1 096 619 | 5/2001 |
| GB | 2 329 530 | 3/1999 |

* cited by examiner

*Primary Examiner*—Gary F. Paumen

(57) ABSTRACT

An electrical connector includes a dielectric housing having a cavity configured to receive a mating connector therein and a contact subassembly having an array of contacts. Each of the contacts define a mating interface configured to engage the mating connector, and each of the contacts have a beam portion extending downstream of the mating interface to a contact terminating end. Contact plates are arranged within the cavity, such that each of the contact plates engage a corresponding one of the contacts at the beam portion of the contacts.

20 Claims, 4 Drawing Sheets

ELECTRICAL CONNECTOR HAVING CONTACT PLATES

BACKGROUND OF THE INVENTION

This invention relates generally to electrical connectors, and more specifically, to electrical connectors having contact plates.

Due to increases in data transmission rates in telecommunications systems, crosstalk has become a significant problem. Crosstalk may be defined as energy which is coupled from one signal line onto a nearby signal line by either capacitive or inductive coupling. This crosstalk results in signal noise which interferes with the purity of the signal being transmitted.

A commonly used telecommunications wiring system is twisted pair wiring wherein pairs of wires are twisted about each other. The wires in a twisted pair carry differential signals and are thus known as signal pairs. Each of the wires in a signal pair carries an equal but opposite signal; that is, the wires carry signals of the same magnitude which are respectively positive and negative. Since these signals are equal but opposite, they generate fields that are equal but opposite. In a twisted pair these equal and opposite fields cancel each other. Thus, little or no crosstalk can occur between one twisted pair and a nearby twisted pair.

Crosstalk in twisted pair wiring systems primarily arises in the electrical connectors which provide an interface between successive runs of cable in a system. One source of the crosstalk is the interface between modular plugs and jacks in the telecommunications system. These connectors have terminals which are spaced closely together and parallel to each other, and this close and parallel arrangement is conducive to crosstalk between nearby lines in different ones of the signal pairs. Further, the terminals in a modular plug are dedicated to specific ones of the twisted wires according to a known industry standard such as Electronics Industries Alliance/Telecommunications Industry Association ("EIA/TIA")-568. Therefore, ends of the wires must be arranged in a closely spaced parallel sequence in the plug, and these parallel ends are also conducive to crosstalk.

Prior art techniques for reducing crosstalk have focused primarily on modular jacks and on the circuit boards of the modular jacks. For example, the circuit boards may route traces in a predetermined pattern to compensate for the crosstalk between the terminals. Since crosstalk increases logarithmically as the frequency of the signal increases, the constant trend toward higher data transmission rates has resulted in a need for further crosstalk reduction. Also, crosstalk which occurs in the modular jack of a communications cable rises significantly at very high frequencies on the order of 250-500 MHz. There is a need for reducing crosstalk in a connector.

BRIEF DESCRIPTION OF THE INVENTION

In one aspect, an electrical connector is provided including a dielectric housing having a cavity configured to receive a mating connector therein and a contact subassembly having an array of contacts. Each of the contacts define a mating interface configured to engage the mating connector, and each of the contacts have a beam portion extending downstream of the mating interface to a contact terminating end. Contact plates are arranged within the cavity, such that each of the contact plates engage a corresponding one of the contacts at the beam portion of the contacts.

Optionally, each of the contact plates may engage the contacts remote with respect to the contact terminating end of the contacts. The contacts plates may be coupled to the housing. Adjacent contact plates may be capacitively coupled to one another, and an amount of capacitive coupling between the adjacent contact plates may be controlled by at least one of a spacing between the contact plates, a size of the contact plates, and an amount of insulative material between the contact plate.

Optionally, the contact plates may engage the contacts at a plate contact interface that is spaced a first distance from the mating interface and a second distance from the contact terminating end, wherein the first distance is shorter than the second distance. The contact plates may be planar and arranged parallel to one another. The contact plates may include a body portion and a spring contact extending from the body portion, wherein the spring contact engaging the corresponding one of the contacts. Optionally, a different number of contact plates may be provided as compared to a number of contacts in the array of contacts.

In another aspect, an electrical connector is provided including a dielectric housing with a mating end and a loading end and having a central wall spaced apart from each of the mating end and the loading end. The housing has a mating connector cavity extending from the mating end to the central wall, and the mating connector cavity is configured to receive a mating connector through the mating end. A contact subassembly is held in the housing and has an array of contacts at least partially exposed to the mating connector cavity. Each of the contacts define a mating interface configured to engage the mating connector, and each of the contacts have a beam portion extending downstream of the mating interface to a contact terminating end. Contact plates are arranged within the housing adjacent the central wall. Each of the contact plates engage a corresponding one of the contacts at the beam portion of the contacts proximate the central wall of the housing.

DETAILED DESCRIPTION OF THE INVENTION

Figure 1:
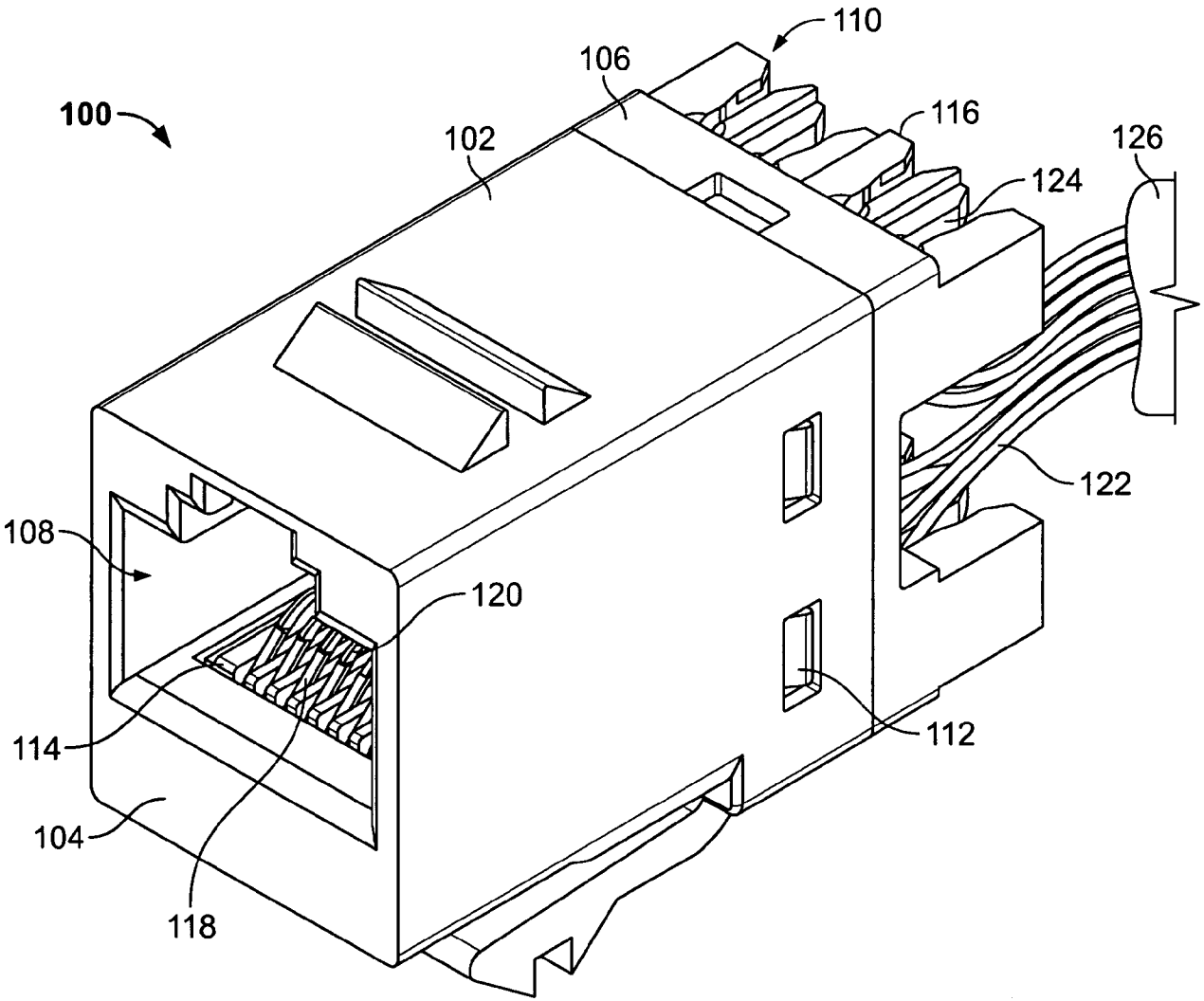
FIG. 1 illustrates a front perspective view of an exemplary electrical connector.

FIG. 1 illustrates a front perspective view of an exemplary electrical connector 100. In the illustrated embodiment, the connector 100 is a modular 8-pin connector, such as an RJ-45 outlet or jack. The connector 100 is configured for joining with a mating plug (not shown).

The connector 100 includes a housing 102 extending between a mating end 104 and a loading end 106. A cavity 108 extends between the mating end 104 and the loading end 106. The cavity 108 receives the mating plug through the mating end 104.

The connector 100 includes a contact sub-assembly 110 received within the housing 102 through the loading end 106 of the housing 102. The contact sub-assembly 110 is secured to the housing 102 via tabs 112. The contact sub-assembly 110 extends between a mating end 114 and a wire terminating end 116 and is held within the housing 102 such that the mating end 114 of the contact sub-assembly 110 is positioned proximate the mating end 104 of the housing 102. The wire terminating end 116 extends outward or rearward from the loading end 106 of the housing 102. The contact sub-assembly 110 includes an array of pins or contacts 118. Each of the contacts 118 include a mating interface 120 arranged within the cavity 108 to interface with corresponding pins or contacts (not shown) of the mating plug when the mating plug is joined with the connector 100. The arrangement of the contacts 118 may be controlled by industry standards, such as the EIA/TIA 568. In an exemplary embodiment, the connector 100 includes eight contacts 118 arranged as differential pairs.

A plurality of communication wires 122 are attached to terminating portions 124 of the contact sub-assembly 110. The terminating portions 124 are located at the wire terminating end 116 of the contact sub-assembly 110. The wires 122 extend from a cable 126 and are terminated to terminating portions 124. Optionally, the terminating portions 124 include insulation displacement connections (IDCs) for terminating the wires 122 to the contact sub-assembly 110. Alternatively, the wires 122 may be terminated to the contact sub-assembly 110 via a soldering connection, a crimping connection, and the like. In an exemplary embodiment, the connector 100 includes eight wires 122 arranged as differential pairs. Optionally, each wire 122 is electrically connected to a corresponding one of the contacts 118. For example, a signal transmitted along each wire 122 may be routed through the connector 100 to the corresponding contact 118.

Figure 2:
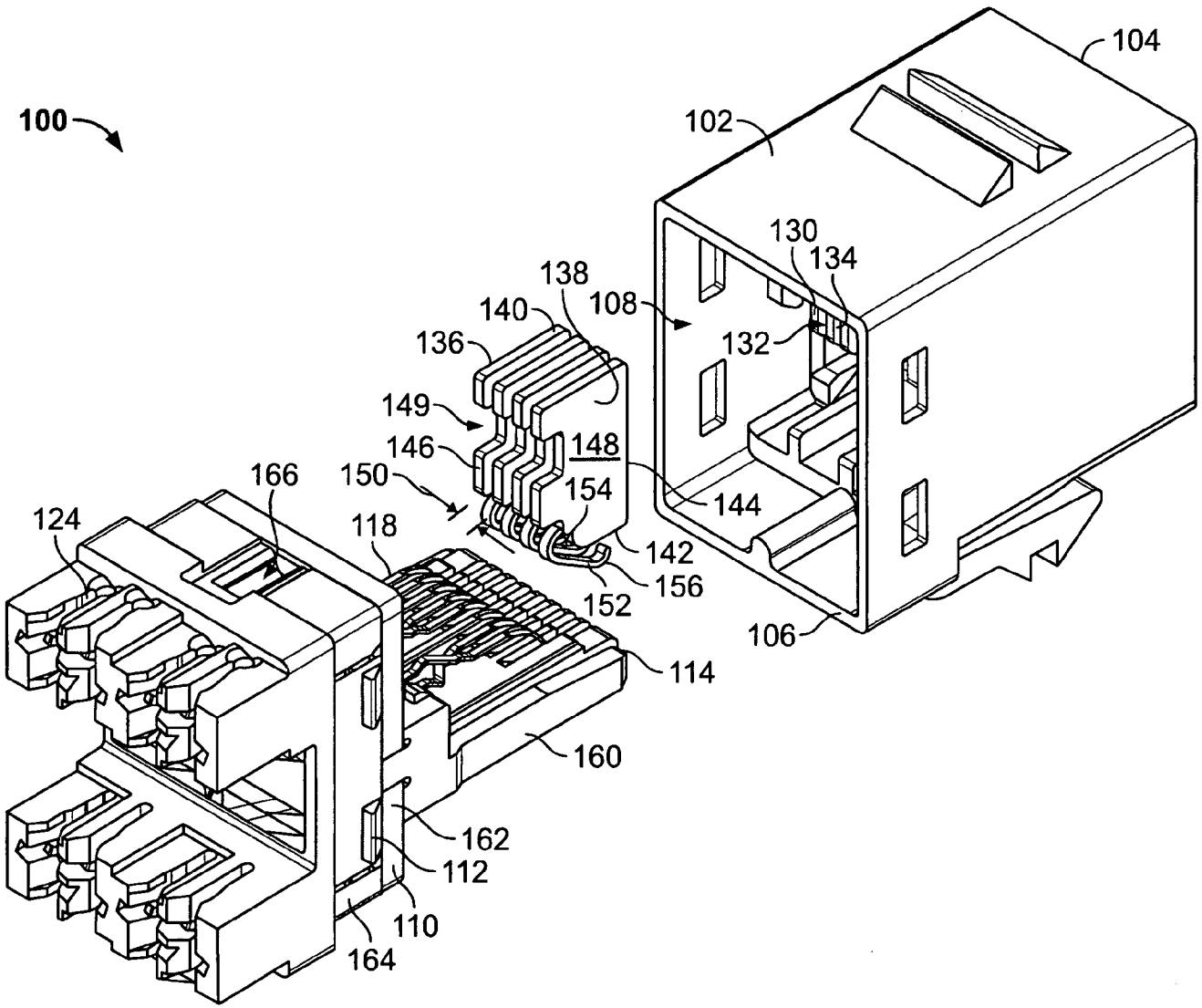
FIG. 2 illustrates an exploded rear perspective view of the electrical connector of FIG. 1.

FIG. 2 illustrates an exploded rear perspective view of the electrical connector 100. In the illustrated embodiment, the loading end 106 of the housing is open to the cavity 108. The housing 102 includes a central wall 130 positioned within the cavity 108. The central wall 130 includes a plurality of parallel slots 132 separated from one another by slot walls 134. Optionally, the slot walls 134 may be made of an insulation material. The slots 132 are arranged to receive contact plates or capacitive plates 136 therein. Optionally, the contact plates 136 may be completely separated by the slot walls 134. Alternatively, the slot walls 134 may separate only a portion of the contact plates 136 such that an air gap extends between adjacent contact plates 136. The contact plates 136 may be held within the slots 132 by a friction fit with the slot walls 134. Alternatively, the contact plates 136 may include barbs that engage the housing 102 to retain the contact plates 136 in position. In an alternative embodiment, the contact plates 136 are joined to and supported by the contact sub-assembly 110. The contact plates 136 are capacitively coupled to one another due to the proximity of the contact plates 136 with one another. When assembled, the contact plates 136 engage the contacts 118 and provide compensation for crosstalk between the contacts 118 and crosstalk within the mating plug through capacitive coupling between the contact plates 136.

In the illustrated embodiment of FIG. 2, four contact plates 136 are received within the connector 100. Optionally, the connector 100 includes less contact plates 136 than contacts 118. Alternatively, the connector 100 may include an equal number of contact plates 136 and contacts 118. Each contact plate 136 has a body 138 including a top 140, a bottom 142, a front 144, a rear 146, and sides 148. Optionally, the rear 146 of each contact plate 136 may include a notched-out portion 149. The sides 148 have a surface area defined by the top 140, the bottom 142, the front 144, and the rear 146. Each contact plate 136 is spaced apart from an adjacent contact plate 136 by a distance 150. The distance 150 and the surface area of the sides 148 affect an amount of a capacitive coupling between adjacent contact plates 136. For example, when the distance 150 between adjacent contact plates 136 is increased, or when the surface area of one or both of the adjacent contact plates 136 is decreased, then the amount of capacitive coupling between the contact plates 136 is decreased. When the distance 150 between adjacent contact plates 136 is decreased, or when the surface area of one or both of the adjacent contact plates 136 is increased, then the amount of capacitive coupling between the contact plates 136 is increased. Optionally, the contact plates 136 may be different sized and shaped, or the contact plates 136 may have different spacing between some of the contact plates 136. Optionally, the type of insulative material of the slot walls 134, or the thickness of the slot walls 134 may be selected to provide a predetermined amount of capacitive coupling between the contact plates 136. Additionally, a portion of the contact plates 136 may be separated by an air gap to provide a predetermined amount of capacitive coupling between the contact plates 136.

In an exemplary embodiment, each contact plate 136 includes a contact member 152 extending from the body 138 to engage the contact 118 of the contact sub-assembly 110. In the illustrated embodiment, the contact member 152 is a spring contact extending between a base portion 154 and a tip portion 156. The contact member 152 extends from the rear 146 of the body 138 proximate the bottom 142.

The contact sub-assembly 110 includes a base 160 extending rearward from the mating end 114 to an integrated circuit 162. The base 160 supports the contacts 118. The contact sub-assembly 110 includes a terminating portion body 164 extending rearward from the integrated circuit 162 to the terminating portions 124. The terminating portion body 164 is sized to substantially fill the rear portion of the cavity 108. Optionally, the terminating portion body 164 may include keying features 166 for orienting the contact sub-assembly 110 with respect to the housing 102 during assembly.

During assembly, the contact plates 136 are loaded into the housing 102 through the loading end 106 of the housing 102 into the slots 132. The contact plates 136 are loaded such that each contact member 152 is oriented to engage the contact sub-assembly 110. The contact sub-assembly 110 is then loaded into the housing 102 through the loading end 106 of the housing 102. When loaded, the base 160 is positioned proximate the mating end 104 of the housing 102 such that the contacts 118 are exposed to the cavity 108. The terminating portion body 164 is partially received within the cavity 108 and substantially fills the rear portion of the cavity 108. The tabs 112 extending from the terminating portion body 164 engage the housing 102 and secure the contact sub-assembly 110 to the housing 102. Additionally, when assembled, the terminating portions 124 are exposed and configured to receive the wires 122 (shown in FIG. 1). Alternatively, the wires 122 may be terminated to the terminating portions 124 prior to loading the contact sub-assembly 110 into the housing 102.

Figure 3:
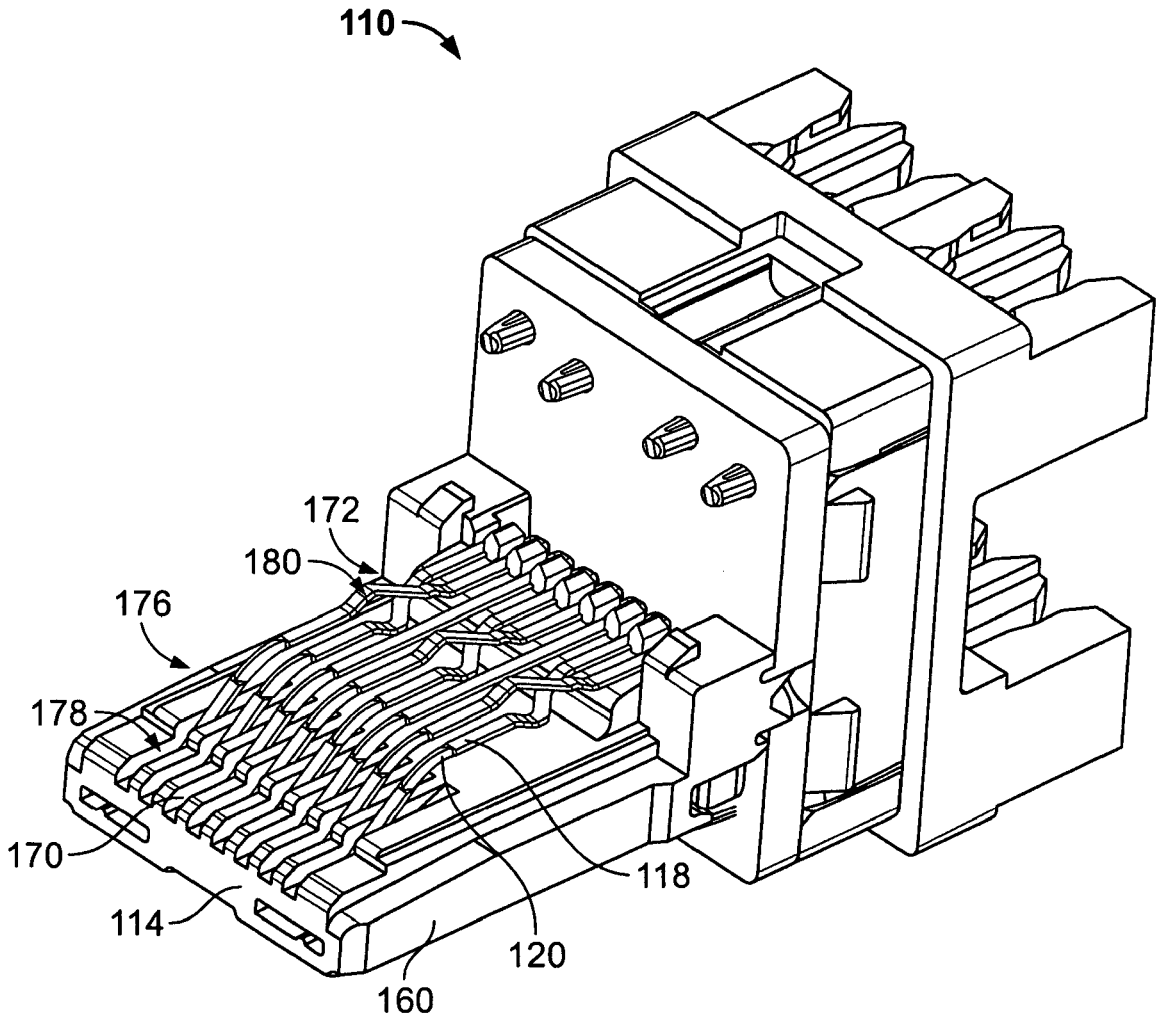
FIG. 3 illustrates a front perspective view of an exemplary contact sub-assembly for the electrical connector of FIG. 1.

FIG. 3 illustrates a front perspective view of the contact sub-assembly 110. As illustrated in FIG. 3, the base 160 extends between the mating end 114 of the contact sub-assembly 110 and the integrated circuit 162. A plurality of parallel channels 170 extend rearward from the mating end 114. Portions of the contacts 118 are received in corresponding channels 170. Optionally, the contacts 118 are movable within the channels 170 to allow flexing of the contacts 118 as the connector 110 is mated with the mating plug. Each of the contacts 118 extends generally parallel to one another and the mating interfaces 120 of each contact 118 are generally aligned with one another.

The contacts 118 each include a beam portion 172 extending from a terminating end 174 (shown in FIG. 4) and a tail portion 176 extending from a front end or tip 178. The mating interface 120 of each contact 118 is positioned between the beam portion 172 and the tail portion 176. The beam portion 172 extends downstream from the mating interface 120 toward the terminating end 174 and the tail portion 176 extends upstream from the mating interface 120 toward the tip 178. The mating interface may include a bend or curved portion such that the tail portion 176 is inclined with respect to the beam portion 172. Optionally, as illustrated in FIG. 3, the beam portion 172 may include a cross-over section 180 downstream of the tail portion 176. The cross-over section 180 changes the pattern or ordering of the beam portions 172 and the tail portions 176 upstream and downstream of the cross-over section.

Figure 4:
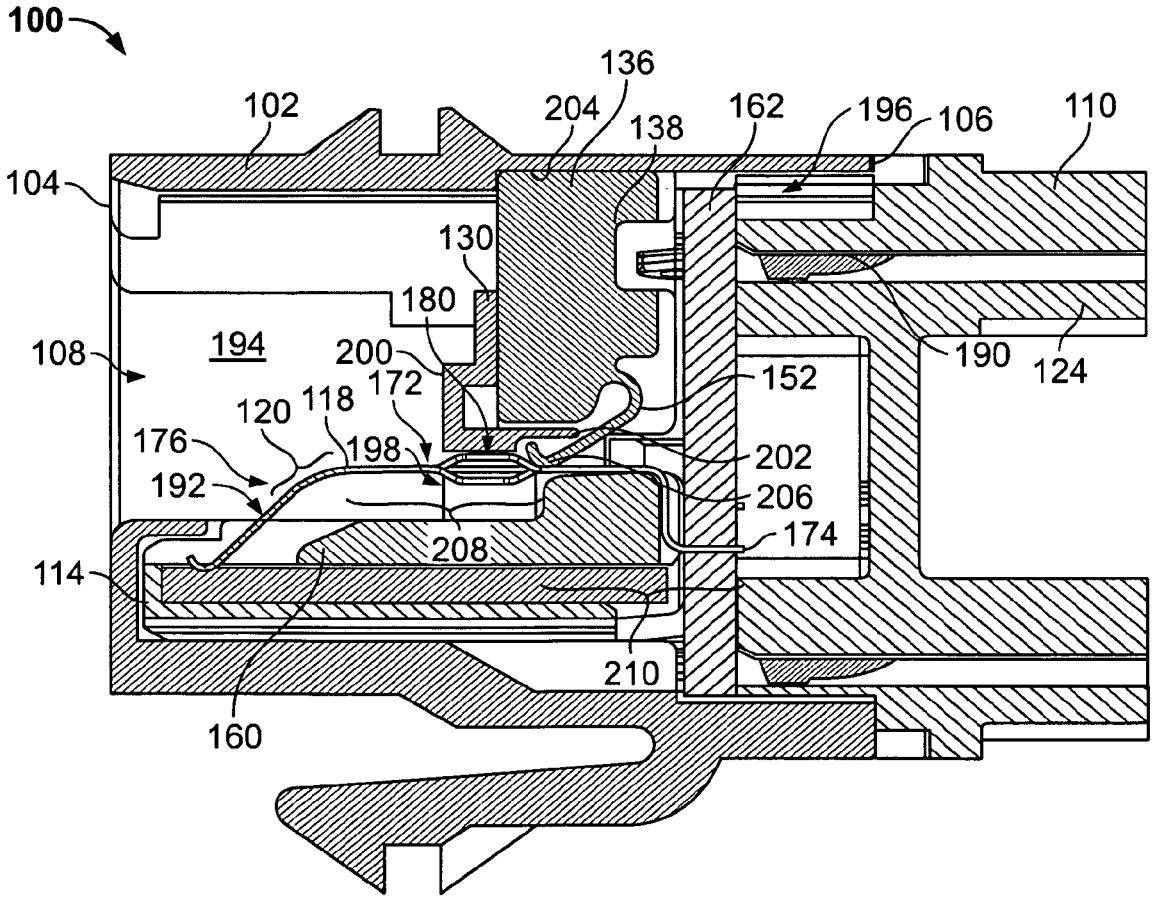
FIG. 4 illustrates a cross sectional view of the electrical connector shown in FIG. 1.

FIG. 4 illustrates a cross sectional view of the electrical connector 100 with the contact sub-assembly 110 received within the housing 102. The terminating portions 124 are exposed toward the rear portion of the connector 100 for interfacing with the wires 122 (shown in FIG. 1). Contacts 190 extend from the terminating portions 124 to the integrated circuit 162. The integrated circuit 162 includes traces (not shown) for routing the signals from the contacts 190 to the contacts 118. The terminating ends 174 of the contacts 118 are terminated to the integrated circuit 162. The contacts 118 may be surface mounted or through-hole mounted to the integrated circuit 162. The beam portions 172 of the contacts 118 are then formed along the base 160 of the contact sub-assembly 110 and the tail portions 176 of the contacts 118 extend forward from the beam portions 172 toward the mating end 114 of the contact sub-assembly 110. Optionally, the tail portions 176 are elevated from the base 160 so the contacts 118 may be flexed toward the base 160 as the mating plug is mated with the connector 100. The tail portions 176 may include an arcuate section 192 at the mating interface 120 to position the contacts 118 to interface with the mating plug.

As illustrated in FIG. 4, the cavity 108 is divided by the central wall 130 into a mating connector cavity 194 extending between the central wall 130 and the mating end 104 of the housing 102, and a contact sub-assembly cavity 196 extending between the central wall 130 and the loading end 106 of the housing 102. An opening 198 extends through the central wall 130 between the mating connector cavity 194 and the contact sub-assembly cavity 196. The base 160 of the contact sub-assembly 110 is loaded through the opening 198 during assembly of the connector 100 such that at least a portion of the contact sub-assembly 110 is exposed to the mating connector cavity 194. For example, the contacts 118 are exposed to the mating connector cavity 194.

The central wall 130 includes the slots 132 that receive the contact plates 136. The slots 132 are defined by a front wall portion 200, a bottom wall portion 202 and a top wall portion 204, which securely retain the contact plates 136. In an exemplary embodiment, when assembled, a section of the contacts 118 extends generally directly below the bottom wall portion 202. Optionally, the contacts 118 may engage the bottom wall portion 202.

The contact member 152 extends from the body 138 of the contact plate 136 to engage the beam portion 172 of the contact 118 at a plate contact interface 206. Each of the contact plates 136 engage a different one of the contacts 118. The capacitive plates 136 are capacitively coupled to one another to provide compensation for crosstalk between the various contacts 118 and crosstalk within the mating plug (not shown). The contact plates 136 are sized, shaped and spaced to provide a predetermined amount of compensation, and in different embodiments, the size, shape and/or spacing may be varied to vary the amount of compensation.

In an exemplary embodiment, the plate contact interface 206 is positioned on the beam portion 172 proximate the tail portion 176. Optionally, the plate contact interface 206 is positioned immediately adjacent and down stream of the cross-over section 180. Moreover, the plate contact interface 206 is positioned remote with respect to the terminating end 174 of the contact 118. For example, the plate contact interface 206 is located along the beam portion 172 a first distance 208 from the mating interface 120 and a second distance 210 from the terminating end 174, wherein the first distance 208 is shorter than the second distance 210. In other words, the plate contact interface 206 is closer to the mating interface 120 than the terminating end 174. As a result, the compensation for the crosstalk between the contacts 118 and crosstalk within the mating plug (not shown) is positioned closer to a source of the crosstalk (e.g. the mating plug) than if the compensation were positioned adjacent the terminating end, such as on the integrated circuit 162. The electrical delay between the source of the crosstalk and the compensation is thus reduced and the compensation is more effective.

A connector 100 is thus provided that provides improving overall crosstalk performance as compared to connectors which do not provide compensation for crosstalk or provide compensation for crosstalk that has a large electrical delay between the source of the crosstalk and the compensation from the crosstalk. The connector 100 is formed in a cost effective and reliable manner. The connector 100 includes contact plates 136 received in the housing 102 which engage the contacts 118 upstream from the terminating end 174 of the contacts 118. The compensation for the crosstalk is thus positioned closer to the source of the crosstalk (e.g. the mating plug). A connector 110 is thus provided having improved electrical performance.

While the invention has been described in terms of various specific embodiments, those skilled in the art will recognize that the invention can be practiced with modification within the spirit and scope of the claims.

What is claimed is:

1. An electrical connector, comprising:

a dielectric housing having a cavity configured to receive a mating connector therein;

a contact subassembly having an array of contacts, each of the contacts defining a mating interface configured to engage the mating connector, and each of the contacts having a beam portion extending at least partially between a tip and a contact terminating end, wherein the beam portion includes the mating interface, and wherein the beam portion defines a compensating section at least partially between the mating interface and the contact terminating end; and contact plates arranged within the cavity, each of the contact plates engaging a corresponding one of the contacts at the compensating section of the beam portion of the contacts.

2. The electrical connector of claim 1, wherein each of the contact plates engage the corresponding one of the contacts remote with respect to the contact terminating end of the contacts.

3. The electrical connector of claim 1, wherein the contact defines a signal path between the mating interface and the contact terminating end, wherein the signal path is complete even if the contact plates are not engaged to the contacts.

4. The electrical connector of claim 1, wherein each of the contacts includes a cross-over portion downstream from the mating interface, the contact plates engaging the corresponding one of the contacts adjacent the cross-over portion.

5. The electrical connector of claim 1, wherein the contact plates engage a corresponding one of the contacts at a plate contact interface, the plate contact interface being spaced a first distance from the mating interface and the plate contact interface being spaced a second distance from the contact terminating end, the first distance being shorter than the second distance.

6. The electrical connector of claim 1, wherein the contact plates are planar and arranged parallel to, and non-coplanar with, one another.

7. The electrical connector of claim 1, wherein each of the contact plates includes a body portion and a spring contact extending from the body portion, the spring contact engaging the corresponding one of the contacts.

8. The electrical connector of claim 1, wherein a different number of contact plates are provided as compared to a number of contacts in the array of contacts.

9. The electrical connector of claim 1, wherein adjacent contact plates are capacitively coupled to one another, an amount of capacitive coupling between the adjacent contact plates being controlled by at least one of a spacing between the contact plates, a size of the contact plates, and an amount of insulative material between the contact plates.

10. The electrical connector of claim 1, wherein each of the contact plates has a planar body defining a contact plate plane that is coplanar with only one contact.

11. An electrical connector, comprising:

a dielectric housing with a mating end and a loading end and having a central wall spaced apart from each of the mating end and the loading end, the housing having a mating connector cavity extending from the mating end to the central wall, the mating connector cavity configured to receive a mating connector through the mating end;

a contact subassembly held in the housing and having an array of contacts at least partially exposed to the mating connector cavity, each of the contacts having a beam portion defining a mating interface configured to engage the mating connector, the beam portion extending to a contact terminating end located downstream of the mating interface; and contact plates arranged within the housing adjacent the central wall, each of the contact plates engaging a corresponding one of the contacts at the beam portion of the contacts downstream of the mating interface proximate the central wall of the housing.

12. The electrical connector of claim 11, wherein each of the contact plates engage the corresponding one of the contacts remote with respect to the contact terminating end of the contacts.

13. The electrical connector of claim 11, wherein a different number of contact plates are provided as compared to a number of contacts in the array of contacts.

14. The electrical connector of claim 11, wherein each of the contacts includes a cross-over portion downstream from the mating interface, the contact plates engaging the corresponding one of the contacts adjacent the cross-over portion.

15. The electrical connector of claim 11, wherein the contact plates engage a corresponding one of the contacts at a plate contact interface, the plate contact interface being spaced a first distance from the mating interface and the plate contact interface being spaced a second distance from the contact terminating end, the first distance being shorter than the second distance.

16. The electrical connector of claim 11, wherein the contact plates are planar and arranged parallel to, and non-coplanar with, one another.

17. The electrical connector of claim 11, wherein each of the contact plates includes a body portion defining a contact plate plane that is coplanar with only one contact.

18. The electrical connector of claim 11, wherein the central wall includes a plurality of slots, each of the contact plates received within a corresponding one of the slots.

19. The electrical connector of claim 11, wherein adjacent contact plates are capacitively coupled to one another, an amount of capacitive coupling between the adjacent contact plates being controlled by at least one of a spacing between the contact plates, a size of the contact plates, and an amount of insulative material between the contact plates.

20. The electrical connector of claim 11, wherein adjacent contact plates engage adjacent ones of the contacts.

* * * * *